United States Patent [19]

Bury

[11] 4,415,285

[45] Nov. 15, 1983

[54] UNIFILLED TAPE CASSETTE

[75] Inventor: John E. Bury, Eltham, England

[73] Assignee: Grafton Limited, London, England

[21] Appl. No.: 371,887

[22] Filed: Apr. 26, 1982

[30] Foreign Application Priority Data

Jul. 23, 1981 [GB] United Kingdom ..... 8122779
Jul. 30, 1981 [GB] United Kingdom ..... 8123330

[51] Int. Cl.[3] ..... B41J 32/02

[52] U.S. Cl. ..... 400/196.1; 400/238; 400/208; 226/91; 242/195

[58] Field of Search ..... 226/91, 92; 242/195, 242/55, 79 A; 400/238, 196.1, 208

[56] References Cited

U.S. PATENT DOCUMENTS 1,298,824 4/1919 Taylor, Jr. ..... 400/238
2,438,063 3/1948 Lorenz-Risler ..... 400/238
2,579,581 12/1951 Hustad ..... 226/91
3,286,808 11/1966 Arena et al. ..... 400/238
3,759,434 9/1973 Lindstrüm et al. ..... 226/91
4,050,617 9/1977 Biggs et al. ..... 400/196.1
4,063,505 12/1977 Sasamoto et al. ..... 226/91
4,247,209 1/1981 Carlson et al. ..... 400/196.1

FOREIGN PATENT DOCUMENTS 2528470 1/1977 Fed. Rep. of Germany ..... 400/238

*Primary Examiner*—William Pieprz
*Attorney, Agent, or Firm*—Pollock, Vande Sande & Priddy

[57] ABSTRACT

An unfilled assembled cassette for fitting to the printhead or platform of a printer or the like has a closed chamber to be packed with inked ribbon and a short length of noninked messenger or leader ribbon threaded along the intended ribbon path. To fill the cassette, ink impregnated ribbon is joined to the messenger ribbon and then wound into the cassette while the messenger ribbon is withdrawn, after which the ends of the ink impregnated ribbon are joined to form a continuous band.

3 Claims, 2 Drawing Figures

UNIFILLED TAPE CASSETTE

FIELD OF THE INVENTION

The present invention relates to an assembled unfilled cassette for printer ribbon and to a method of completing it.

BACKGROUND TO THE INVENTION

Traditionally typewriters or printers have used fabric ribbons which are wound from reel to reel. With golf-ball typewriters and more recently needle and daisy wheel printers and the like there has been a tendency to enclose the ribbon in a disposable cartridge or cassette. Such cassettes are injection moulded in a plastics material and have an inlet to and an outlet from an otherwise closed chamber in which an inked textile ribbon is stuffed in serpentine manner so that the chamber is tightly packed. Ribbon may be pulled out through the outlet of the chamber and may be returned into the chamber by means of a ribbon transport roller in the chamber adjacent to the inlet which bears upon either an idler roller or a pressure plate so as frictionally to engage ribbon travelling past it. A formation on an accessible portion of the transport roller (which is normally journalled in the upper and lower halves of the cassette) engages in a rotary drive member on the printhead or platform or the like so that the inked ribbon is advanced stepwise as the characters are printed. Guides may extend for the inlet and outlet (though not all cassettes have them) and the free ends of the inked ribbon are joined to form an endless loop.

The present practice is for the parts of the cassette to be made first and sold in pieces to a ribbon manufacturer. In accordance with existing practice such a manufacturer assembles the component parts, threads the inked ribbon through the body or pan of the cassette, and places the lid on and holds it in place while the internal cavity is being stuffed with inked ribbon, after which the lid is assembled to the body, e.g. by pin fixing. The free ends of the inked ribbon are then joined together, e.g. by ultrasonic butt welding. But this is a time-consuming operation because individual pieces of the cassette have to be unpacked, identified, assembled and the cassette threaded manually, then it has to be stuffed with ribbon, and finally the ribbon has to be butt welded. This is a labor-intensive process for the ribbon manufacturer who also has to invest in the necessary machinery. It is an object of the present invention to provide an unfilled cartridge system that is simpler from the standpoint of the ribbon manufacturer.

SUMMARY OF THE INVENTION

This invention is based on the realization that it is advantageous to make available unfilled cassettes in fully assembled condition, utilizing a short length of noninked messenger ribbon (which could also be described as a "leader") which is threaded between the inlet and the outlet of the cassette with exposed flying ends or with an exposed loop that may be cut by the user to define flying ends.

Another aspect of the invention provides a method of making an inked tape cassette which comprises threading a short length of noninked messenger ribbon through the body of the cassette so that flying portions protrude outwardly of the cassette body through inlet and outlet openings in the body, assembling the lid of the cassette to the body, joining the ink-impregnated ribbon to the noninked messenger ribbon protruding from the inlet opening, withdrawing the messenger ribbon from the outlet opening until a short length of the ink-impregnated ribbon protrudes therefrom, winding the ink-impregnated ribbon into the cassette until it is filled, and joining the exposed lengths of the ink-impregnated ribbon between the inlet and outlet to form an endless loop.

It is preferred that the messenger ribbon be of a visibly distinct color to the ink-impregnated ribbon and it may conveniently be white.

BRIEF DESCRIPTION OF THE DRAWINGS

An embodiment of the invention will now be described by way of example only with reference to the accompanying drawings, FIG. 1 of which is a partly cut away plan view of an inked fabric ribbon cassette in its unfilled state with a noninked messenger ribbon threaded through, and FIG. 2 of which shows the cartridge with flying ends of messenger ribbon.

DESCRIPTION OF THE PREFERRED EMBODIMENTS

Figure 1:
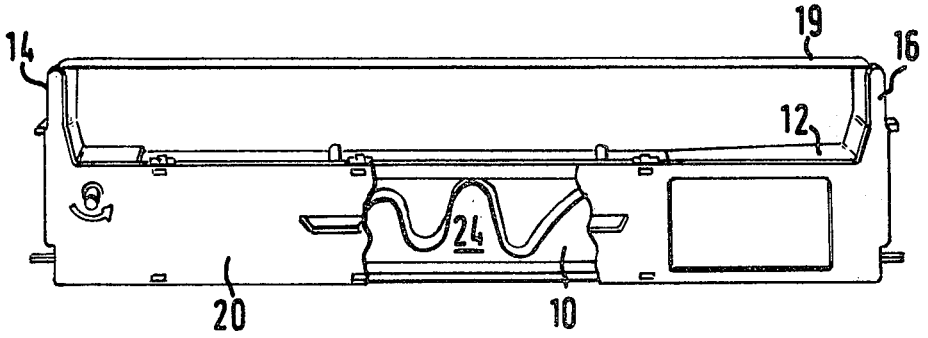
Figure 2:
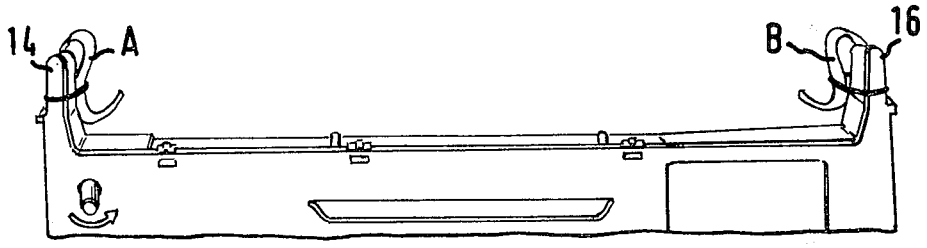

In FIG. 1 a body or pan 10 of a ribbon cassette is injection moulded in a plastics material and has a peripheral wall 12 formed with an inlet opening 14 and an outlet opening 16. A short length of noninked messenger ribbon 19 is threaded through the cassette, passing from the inlet 14 between a ribbon transport roller and a spring into the ribbon space 24 past an opposed spring which imposes a tension on ribbon leaving the cavity and thence through outlet 16. In the form as sold the noninked messenger ribbon may take the form of a continuous loop, but it is cut to define flying ends A and B (FIG. 2) of the messenger ribbon that protrude outwardly from respective openings 14 and 16. The lid 20 is assembled to the body of pan of the cassette in conventional manner and the cassette is supplied to ribbon manufacturers as such with the ribbon transport system already in place and with the messenger ribbon (typically a woven tape white in color or of any other flexible material) already threaded through the cassette.

The ribbon manufacturer attaches the leading end of the inked ribbon to the flying end A of the messenger ribbon and places the cassette in a ribbon stuffing machine. The attachment may be made mechanically, e.g. by a staple, by heat-welding, by sewing, or by any other method. But preferably a strip adhesive having a latex base compatible with the solvents in the ribbon ink is placed latex face down on the uninked messenger ribbon and the cover paper is removed exposing the adhesive which then readily accepts the inked ribbon. This is particularly important because the leading edge of the inked ribbon must be held firmly down so that no threads can catch on projections within the cassette. The stuffing machine is driven to draw the flying end A of the messenger ribbon slowly through the cassette, the operator pulling the end B of the messenger ribbon through until inked ribbon protrudes from the outlet 16. Then the stuffing machine is driven at high speed to fill the cavity 24 with an appropriate length of inked ribbon. The resulting filled cartridge now has flying ends of inked ribbon protruding from openings 14 and 16 and following detachment of the non-inked messenger ribbon from the inked ribbon these flying ends are butt-welded together to define an endless band of inked ribbon.

I claim:

1. A method of making a cassette filled with an inked ribbon, said method comprising the steps of:

providing a cassette body having means defining a ribbon space to be packed with an inked ribbon in serpentine manner, said body including means defining a ribbon inlet leading to said space, means defining a ribbon outlet leading from said space, and means for transporting ribbon through said cassette body;

threading a short length of noninked messenger ribbon between the said ribbon inlet and the said ribbon outlet along the intended ribbon path through said ribbon space and past said ribbon transport means with portions of said noninked messenger ribbon protruding outwardly from both the ribbon inlet and the ribbon outlet of the cassette body;

assembling a lid to the cassette body to form an assembled and sealed cassette with portions of said noninked messenger ribbon maintained protruding from both the ribbon inlet and the ribbon outlet;

attaching inked ribbon to the portion of said noninked messenger ribbon protruding from said ribbon inlet;

transporting ribbon through said cassette until the inked ribbon that was joined to the portion of noninked messenger ribbon protruding from the ribbon inlet has appeared at the ribbon outlet and the noninked messenger ribbon has been completely withdrawn from said cassette;

thereafter transporting the inked ribbon into the cassette until the ribbon space is filled with inked ribbon;

detaching said non-inked messanger ribbon from said inked ribbon; and joining exposed portions of the inked ribbon now protruding from the ribbon inlet and the ribbon outlet of the cassette to form an endless loop of inked ribbon.

2. A method according to claim 1 wherein the portion of the noninked messenger ribbon protruding from the ribbon inlet is attached to the inked ribbon by means of a strip of adhesive coated material.

3. A method according to claim 1, wherein the noninked messenger ribbon has a color that is visually distinct from that of the inked ribbon.

* * * * *